US006662521B1

(12) United States Patent
Escobedo et al.

(10) Patent No.: US 6,662,521 B1
(45) Date of Patent: Dec. 16, 2003

(54) MULTIPURPOSE DRYWALL TOOL

(76) Inventors: Alfred William Escobedo, 21008 S. Cooper Rd., Chandler, AZ (US) 85249; James M. Escobedo, 14105 E. Buffalo St., Gilbert, AZ (US) 85249

( * ) Notice: Subject to any disclaimer, the term of this patent is extended or adjusted under 35 U.S.C. 154(b) by 16 days.

(21) Appl. No.: 10/137,241

(22) Filed: May 2, 2002

(51) Int. Cl.[7] ..... E04F 15/16

(52) U.S. Cl. ..... 52/746.1; 362/19; 362/119; 7/105; 7/165

(58) Field of Search ..... 362/119, 19; 7/105, 7/165; 49/383; 52/746.1

(56) References Cited

U.S. PATENT DOCUMENTS 4,300,607 A * 11/1981 Mellinger ..... 81/490
5,063,627 A * 11/1991 Marra ..... 7/105
5,720,063 A * 2/1998 Chacon ..... 7/165
6,012,820 A * 1/2000 Weber et al. ..... 362/19
6,134,839 A * 10/2000 Johansson ..... 49/383
6,203,165 B1 * 3/2001 Chen ..... 362/119
6,425,155 B1 * 7/2002 Carey ..... 7/105
6,568,087 B1 * 5/2003 Gringer ..... 30/169

* cited by examiner

*Primary Examiner*—Sandra O'Shea
*Assistant Examiner*—James W Cranson, Jr.

(57) ABSTRACT

A multipurpose drywall tool comprising a blade attached to the front end of a handle in which the rear corner end of the handle is attached to opposing rounded hardened hammer members. Also attached to the distal end of the handle is attached an engaging means disposed within a orifice in the distal end of the handle. The engaging means for disengagably engaging a screwdriver bit. One preferred configuration of the engaging means is a protrusion attached at an edge of the screwdriver bit and a flange attached at the edge of the orifice, so that the flange is adapted to reversibly receive the protrusion in a frictional interlocking relationship when the screwdriver bit is inserted into the orifice. Yet another preferred configuration of the engaging means comprises a magnet within the orifice, in which the magnet is adapted to reversibly receive the screwdriver bit when the screwdriver bit is inserted into the orifice. A speaker and a light source with an electrical power source embedded within the tool can also be provided.

1 Claim, 3 Drawing Sheets

MULTIPURPOSE DRYWALL TOOL

FIELD OF THE INVENTION

The present invention relates to hand tools, in particular to a multipurpose drywall tool for use in connection with working drywall.

DESCRIPTION OF THE PRIOR ART

In the operation and erection of various drywall slabs in a construction site, a wide variety of tools are frequently required, such as, a scraping blade for scraping and smoothing putty; a screwdriver for adjusting protruding screws; a hammer for pounding down protruding nails; a flashlight for diagnosing the smoothness of a surface; and a horn for drawing the attention of nearby workers while suspended on various scaffolding. A variety of tools have been devised for use in working drywall. All such prior drywall tools have significant shortcomings. For example, the combination putty-knives and screw drivers disclosed by Bartlett in U.S. Pat. No. 180,187; the drywall tool disclosed by Marra in U.S. Pat. No. 5,063,627; the drywall knife having a screwdriver bit and dimple forming projection disclosed by Chacon in U.S. Pat. No. 5,720,063; the utility tool disclosed by Papadopoulos in U.S. Pat. No. 5,870,786; the trowell and screwdriver combination handtool disclosed by Anderson and Cassutti in U.S. Pat. No. 6,131,222; and the combination putty knife and screwdriver disclosed by Lehmann in U.S. Pat. No. D380,661.

While all of the above-described devices fulfill their respective, particular objectives and requirements, the aforementioned patents do not describe a putty knife having a handle with a pair of rounded hammer members attached to opposing corners of the distal end of the handle in which a screwdriver bit is also attachable to the distal end of the handle within an orifice. These integrated elements within a single putty knife specifically match the user's particular individual needs of an easy to use tool which is effective in drywall construction situations. As such, it may now be appreciated that there continues to be a need for a new and improved drywall tool as set for by the present invention which addresses both the problems of ease of use as well as effectiveness of using an integrated tool in construction settings and in this respect, the present invention substantially fulfills this need.

Therefore, a need exist for a new and improved multipurpose drywall tool that can be used for pounding down protruding nails and screws as well as a drywall tool that can unscrew or screws down screws. In this respect, the multipurpose drywall tool according to the present invention substantially departs from the conventional concepts and designs of the prior art, and in doing so provides an apparatus primarily developed for the purpose of making available an multipurpose drywall tool so that users can have a fully integrated tool that is capable of fulfilling a myriad of task at the worksite.

SUMMARY OF THE INVENTION

The present device, according to the principles of the present invention, overcomes the shortcomings of the prior art by providing a multipurpose drywall tool comprising a blade attached to the front end of a handle in which the rear corner end of the handle are attached two opposing rounded hardened hammer members. Also attached to the distal end of the handle is attached an engaging means disposed within a orifice in the distal end of the handle. The engaging means for disengagably engaging a screwdriver bit. One preferred configuration of the engaging means is a protrusion attached at an edge of the screwdriver bit and a flange attached at the edge of the orifice, so that the flange is adapted to reversibly receive the protrusion in a frictional interlocking relationship when the screwdriver bit is inserted into the orifice. Yet another preferred configuration of the engaging means comprises a magnet within the orifice, in which the magnet is adapted to reversibly receive the screwdriver bit when the screwdriver bit is inserted into the orifice.

In view of the foregoing disadvantages inherent in the known type putty knife devices now present in the prior art, the present invention provides an improved multipurpose drywall tool, which will be described subsequently in great detail, is to provide a new and improved multipurpose drywall tool which is not anticipated, rendered obvious, suggested, or even implied by the prior art, either alone or in any combination thereof.

To attain this, the present invention essentially comprises a multipurpose drywall tool that comprises a blade attached to the front end of a handle in which the rear corner end of the handle are attached two opposing rounded hardened hammer members. Also attached to the distal end of the handle is attached an engaging means disposed within a orifice in the distal end of the handle. The engaging means for disengagably engaging a screwdriver bit. One preferred configuration of the engaging means is a protrusion attached at an edge of the screwdriver bit and a flange attached at the edge of the orifice, so that the flange is adapted to reversibly receive the protrusion in a frictional interlocking relationship when the screwdriver bit is inserted into the orifice. Yet another preferred configuration of the engaging means comprises a magnet within the orifice, in which the magnet is adapted to reversibly receive the screwdriver bit when the screwdriver bit is inserted into the orifice.

There has thus been outlined, rather broadly, the more important features of the invention in order that the detailed description thereof that follows may be better understood, and in order that the present contribution of the art may be better appreciated.

The invention may also include a light source with an electrical power source embedded within the tool handle. The invention may also include a speaker source with an electrical power source embedded within the tool handle. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multipurpose drywall tool that has all the advantages of the prior art multipurpose drywall tool and none of the disadvantages.

It is another object of the present invention to provide a new and improved multipurpose drywall tool that may be easily and efficiently manufactured and marketed.

An even further object of the present invention is to provide a new and improved multipurpose drywall tool that has a low cost of manufacture with regard to both materials and labor, and which accordingly is then susceptible of low prices of sale to the consuming public, thereby making such multipurpose storage unit and system economically available to the buying public.

Still another object of the present invention is to provide a new multipurpose drywall tool that provides in the apparatuses and methods of the prior art some of the advantages thererof, while simultaneously overcoming some of the disadvantages normally associated therewith.

Even still another object of the present invention is to provide a multipurpose drywall tool for putty knife having a pair of rounded hammer members on opposing corners of the distal end of the handle. This makes it possible to allow the user to pound down nails or screws and the like, with this one integrated tool.

Yet another object of the present invention is to provide a multipurpose drywall tool having an attachable screwdriver bit mounted within an orifice at the distal end of the handle. This makes it possible for the user to have available a screwdriving means integrated within this present invention to unscrew or to screw screws.

Still another object of the present invention is to provide a new and improved drywall tool wherein the same utilizes a multiplicity of various tool members mounted to a single structure to accommodate various procedures encountered in drywall construction.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompany drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
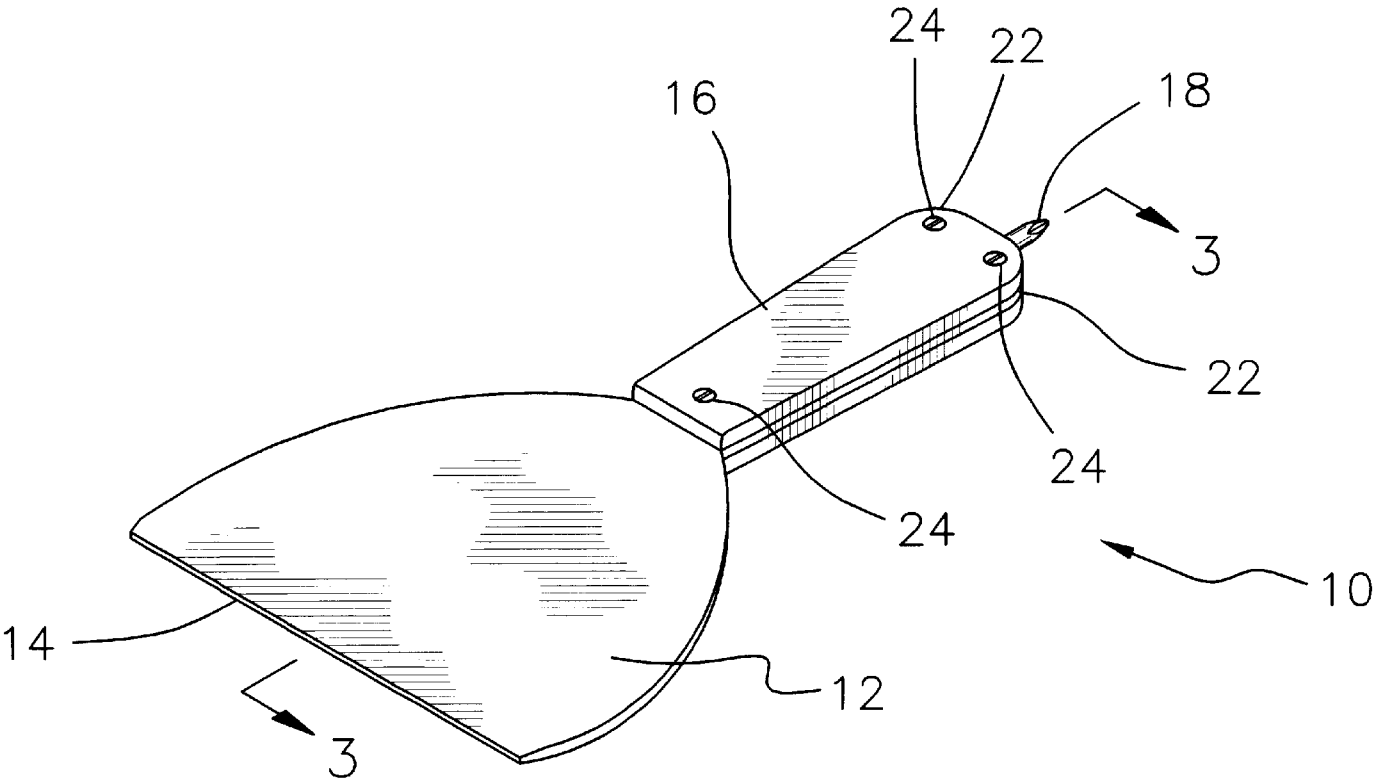
FIG. 1 is a perspective view of one of the preferred embodiments of the multipurpose drywall tool constructed in accordance with the principles of the present invention.
Figure 2:
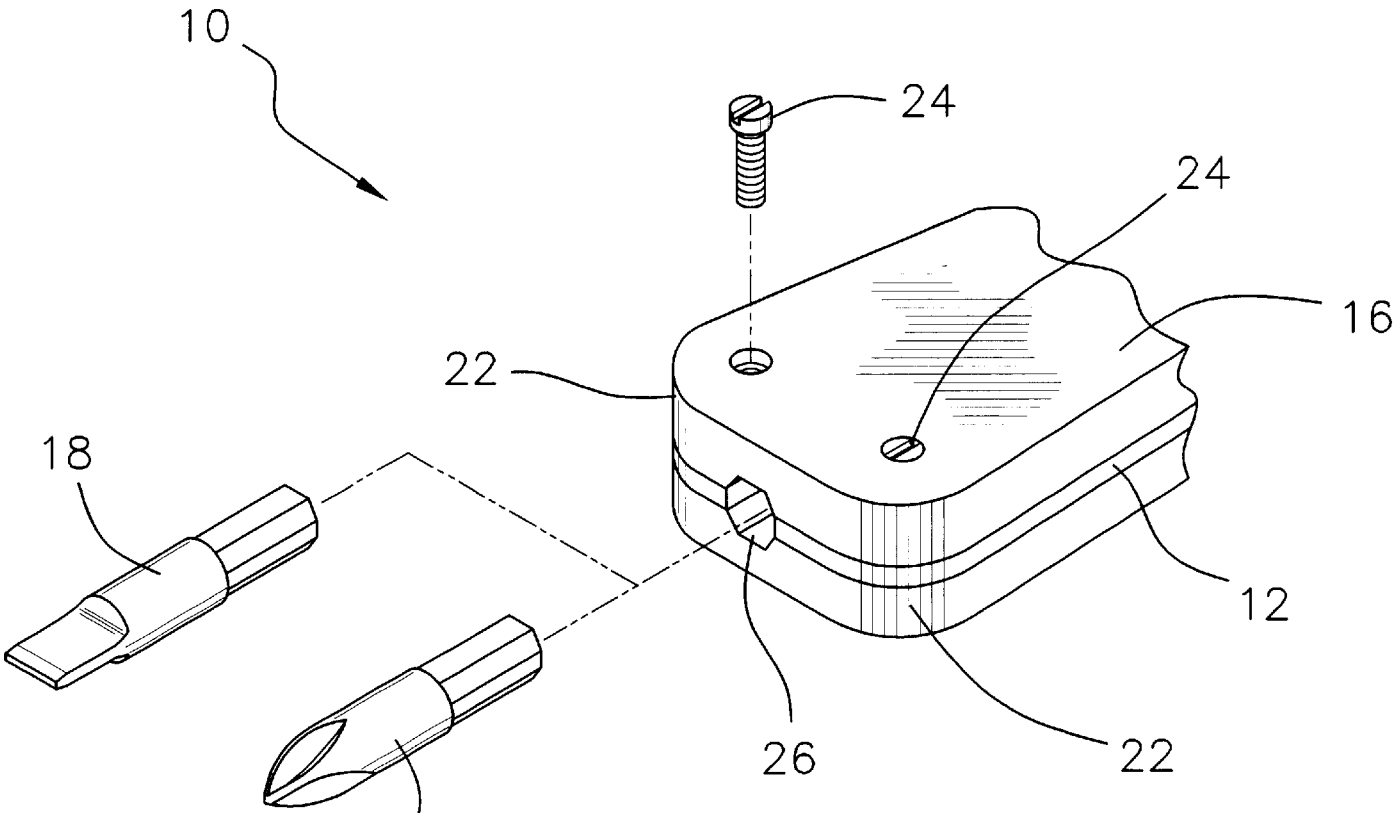
FIG. 2 is a distal end view of the handle of one of the preferred embodiments of the multipurpose drywall tool of the present invention.
Figure 3:
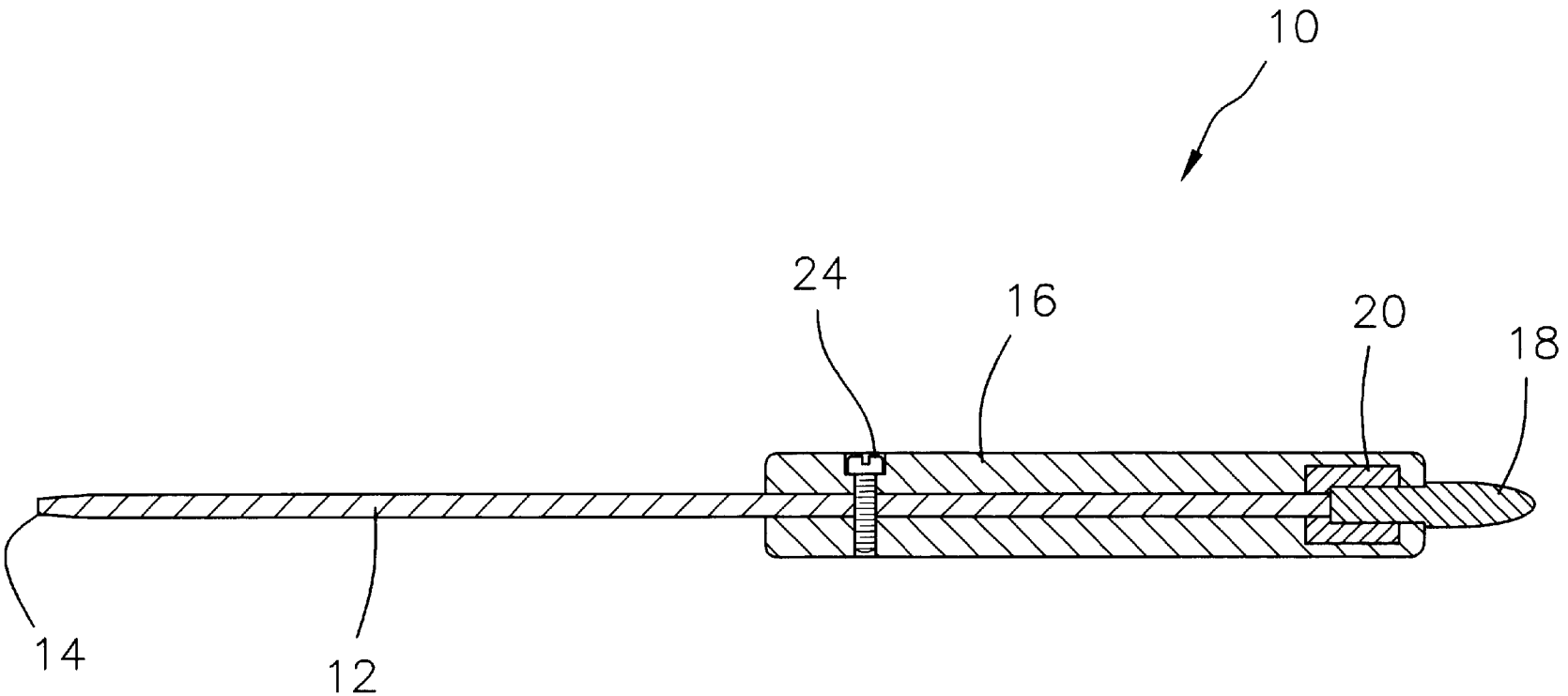
FIG. 3 is a cross sectional view of the multipurpose drywall tool of the present invention.

With reference now to the drawings, and in particular to FIGS. 1 to 3 thereof, a new and improved multipurpose drywall tool embodying the principles and concepts of the present invention and generally designated by the reference numeral 10 will be described. One preferred embodiment of the multipurpose drywall tool 10 comprises: a blade 12 which has an edge 14 extending traversely to a longitudinal axis of the blade 12; a handle 16 having a proximate and distal end, the distal end of the handle 16 having two opposing corners, the proximate end of the handle 16 attached to the blade 12; a screwdriver bit 18; an engaging means 20 disposed within a orifice 26 in the distal end of the handle 16, the engaging means 20 for disengagably engaging the screwdriver bit 18; and a pair of rounded hammer members 22 attached to the two opposing corners of the distal end of the handle 16.

Another preferred embodiment of the present invention of a multipurpose drywall tool 10 comprises: a blade 12 having an edge 14 extending traversely to a longitudinal axis of the blade 12, wherein the length of the edge 14 is at least four inches. The handle 16 having a proximate and distal end, the distal end of the handle 16 having two opposing corners, the proximate end of the handle 16 attached to the blade 12. A screwdriver bit 18 is selected from the group consisting of a Phillips-head bit and a slotted bit. An engaging means 20 disposed within a orifice 26 in the distal end of the handle 16. The engaging means 20 for disengagably engaging the screwdriver bit 18 in which the engaging means 20 comprises a magnet within the orifice 26, the magnet adapted to reversibly receive the screwdriver bit 18 when the screwdriver bit 18 is inserted into the orifice 26. Finally, a pair of rounded hammer members 22 attached to the two opposing corners of the distal end of the handle 16. The pair of rounded hammer members 22 are composed of metallic material selected from the group consisting of aluminum, tin, copper, iron, nickel, manganese, titanium, carbon steel, stainless steel, galvanized steel, brass, bronze and mixtures thereof.

Yet another preferred embodiment of the multipurpose drywall tool 10 comprises a blade 12 having an edge 14 extending traversely to a longitudinal axis of the blade 12, wherein the length of the edge 14 is at least four inches and the edge 14 of the blade 12 extends substantially perpendicular to the longitudinal axis of the blade 12. A handle 16 having a proximate and distal end, the distal end of the handle 16 having two opposing corners, the proximate end of the handle 16 attached to the blade 12. A screwdriver bit 18, in which the screwdriver bit 18 is selected from the group consisting of a Phillips-head bit and a slotted bit. An engaging means 20 disposed within a orifice 26 in the distal end of the handle 16. The engaging means 20 for disengagably engaging the screwdriver bit 18 in which the engaging means 20 comprises a magnet within the orifice 26. The magnet is adapted to reversibly receive the screwdriver bit 18 when the screwdriver bit 18 is inserted into the orifice 26. A pair of rounded hammer members 22 attached to the two opposing corners of the distal end of the handle 16, in which the pair of rounded hammer members 22 are composed of metallic material selected from the group consisting of aluminum, tin, copper, iron, nickel, manganese, titanium, carbon steel, stainless steel, galvanized steel, brass, bronze and mixtures thereof. A cubbyhole disposed in the handle 16, the cubbyhole for slidably engaging the screwdriver bit 18. A light bulb mounted on the handle 16, in which the light bulb for illuminating a drywall surface. A switch electrically connected to the light bulb, in which the switch is mounted on the handle 16. A cavity is located within the handle 16. A speaker positioned within the cavity of the handle 16, in which the speaker is electrically connected to the switch. The speaker is capable of making an audible sound when the switch is enabled by a user. Finally, a power supply electrically connected to the switch, the power supply positioned within the cavity of the handle 16, in which the power supply is a battery.

The engaging means 20 of the multipurpose drywall tool 10 may comprise any number of standard commercially available means for securing a screwdriver bit 18 into a socket. One preferred embodiment of the engaging means 20 is a protrusion attached at an edge 14 of the screwdriver bit 18; and a flange attached at the edge 14 of the orifice 26, the flange adapted to reversibly receive the protrusion in a frictional interlocking relationship when the screwdriver bit 18 is inserted into the orifice 26. Yet another preferred embodiment of the engaging means 20 comprises a magnet within the orifice 26, in which the magnet is adapted to reversibly receive the screwdriver bit 18 when the screwdriver bit 18 is inserted into the orifice 26.

The edge 14 of the blade 12 of the multipurpose drywall tool 10 may optionally extends substantially perpendicular to the longitudinal axis of the blade 12. The width of the edge 14 on the blade 12 of the multipurpose drywall tool 10 may be any size desirable to the user. One preferred optional width of the edge 14 of the blade 12 is that it is at least four inches. Another preferred optional width of the edge 14 of the blade 12 is that it is at least ten inches.

The pair of rounded hammer members 22 of multipurpose drywall tool 10 may be composed of any sturdy material capable of pounding down a nail or a screw. One optional embodiment of the compositional makeup of the rounded hammer members 22 is that they are composed of metallic material selected from the group consisting of aluminum, tin, copper, iron, nickel, manganese, titanium, carbon steel, stainless steel, galvanized steel, brass, bronze and mixtures thereof.

The screwdriver bit 18 may optionally be any commonly available screwdriver bits commercially available, for example a Phillips-head bit, a slotted bit, or even a double ended element having a Phillips-head bit at one end and a slotted bit at the other end of the double ended element.

The handle 16 of the multipurpose drywall tool 10 may comprise any number of optional additional elements. Such as, an optional cubbyhole built within the handle in which the cubbyhole for slidably engaging the screwdriver bit 18. Also an optional door may be pivotally hinged to the handle 16 in which the door is for containing the screwdriver bit 18 within the cubbyhole when the door is in a closed position and the door for allowing a user access into the cubbyhole when the door is in an open position.

The multipurpose drywall tool 10 may also optionally comprise a light bulb mounted on the handle 16, in which the light bulb for illuminating a drywall surface. Electrically connected to the light bulb is an optional switch in which the switch mounted on the handle 16. The handle may also comprise a cavity within the handle 16 and comprise a power supply electrically connected to the switch in which the power supply positioned within the cavity of the handle 16. The power supply may be a battery. Finally the battery may comprise a rechargeable battery mounted in the handle 16 and having a connector means enabling the rechargeable battery to be recharged from a remote electrical power source.

The multipurpose drywall tool 10 may also optionally comprise a speaker means for use by a user in making a loud noise to draw attention to the user in a high noise work environment. The optional speaker means comprises a hollow chamber in the handle; a power supply positioned within the hollow chamber of the handle 16; a switch mounted on the handle 16, the switch electrically connected to the power supply; and a speaker positioned within the hollow chamber of the handle 16, the speaker electrically connected to the switch, the speaker capable of making an audible sound when the switch is enabled. The power supply may be a battery. The battery may comprise a rechargeable battery mounted in the handle 16 and having a connector means enabling the rechargeable battery to be recharged from a remote electrical power source.

Referring to FIG. 1 illustrates a perspective view of one of the preferred embodiments of the multipurpose drywall tool 10 showing a blade 12 that has an edge 14 extending traversely to a longitudinal axis of the blade 12. The proximate end of the handle 16 is attached to the blade 12. A screwdriver bit 18 is attached to the handle 16 via an engaging means 20 disposed within a orifice 26 in the distal end of the handle 16. Finally, a pair of rounded hammer members 22 attached to the two opposing corners of the distal end of the handle 16. The exact configuration of the pair of rounded hammer members 22 may optionally comprise any number of different embodiments, so long as the pair of rounded hammer members 22 are sufficiently strong enough to withstand the necessary forces required to pound a nail or a screw through drywall. The configuration shown in FIG. 1 for the pair of rounded hammer members 22 is composed of the butt end of the blade 12 enshrouded with two laminated layers secured to the butt end of the blade 12 with three recessed bolts 24. Another optional configuration of the pair of rounded hammer members 22 may be composed of individual sheaths around the corners of the distal end of the handle 16.

Referring now to FIG. 2 that illustrates a distal end view of the handle 16 of one of the preferred embodiments of the multipurpose drywall tool 10 of the present invention. The screwdriver bit 18 may optionally be any commonly available screwdriver bits 18 commercially available, for example a Phillips-head bit, a slotted bit, or even a double-ended element having a Phillips-head bit at one end and a slotted bit at the other end of the double ended element. An engaging means 20 for disengagably engaging the screwdriver bits 18 is disposed within a orifice 26 in the distal end of the handle 16. The engaging means 20 may comprise any number of standard commercially available means for securing a screwdriver bit 18 into a socket. Shown here in FIG. 2 is the engaging means 20 is part of the orifice 26, in that a octagonally shaped orifice 26 is capable of slideably accepting an octagonally shaped distal end of the screwdriver bits 18. Another preferred embodiment of the engaging means 20 is a protrusion attached at an edge 14 of the screwdriver bit 18; and a flange attached at the edge 14 of the orifice 26, the flange adapted to reversibly receive the protrusion in a frictional interlocking relationship when the screwdriver bit 18 is inserted into the orifice 26. Also shown in FIG. 2 is the pair of rounded hammer members 22 attached to the two opposing corners of the distal end of the handle 16. The exact configuration of the pair of rounded hammer members 22 may optionally comprise any number of different embodiments, so long as the pair of rounded hammer members 22 are sufficiently strong enough to withstand the necessary forces required to pound a nail or a screw through drywall. The configuration shown in FIG. 2 for the pair of rounded hammer members 22 is composed of the butt end of the blade 12 enshrouded with two layers secured to the butt end of the blade 12 with recessed bolts 24. Another optional configuration of the pair of rounded hammer members 22 may be composed of individual sheaths around the corners of the distal end of the handle 16.

Referring now to FIG. 3 which illustrates a cross sectional view of the multipurpose drywall tool 10 of the present invention showing a blade 12 which has an edge 14 extending traversely to a longitudinal axis of the blade 12. The proximate end of the handle 16 is attached to the blade 12. A screwdriver bit 18 is attached to the handle 16 via an engaging means 20 disposed within a orifice 26 in the distal end of the handle 16. The engaging means 20 configuration illustrated in FIG. 3 is a magnet within the orifice 26, in which the magnet is adapted to reversibly receive the screwdriver bit 18 when the screwdriver bit 18 is inserted into the orifice 26. Also shown in FIG. 3 are two layers secured over the butt end of the blade 12 with recessed bolts 24 making up the handle 16 as well as the pair of rounded hammer members 22.

As to the manner of usage and operation of the present invention, the same should be apparent from the above description. Accordingly, no further discussion relating to the manner of usage and operation will be provided.

While a preferred embodiment of the multipurpose drywall tool has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of using a multipurpose drywall tool comprising the steps of:

obtaining the multipurpose drywall tool comprising:

a blade having an edge extending traversely to a longitudinal axis of the blade, wherein the length of the edge is at least four inches;

a handle having a proximate and distal end, the distal end of the handle having two opposing corners, the proximate end of the handle attached to the blade;

a screwdriver bit, wherein the screwdriver bit is selected from the group consisting of a Phillips-head bit and a slotted bit;

an engaging means disposed within a orifice in the distal end of the handle, the engaging means for disengagably engaging the screwdriver bit, wherein the engaging means comprises a magnet within the orifice, the magnet adapted to reversibly receive the screwdriver bit when the screwdriver bit is inserted into the orifice; and a pair of rounded hammer members attached to the two opposing corners of the distal end of the handle, wherein the pair of rounded hammer members are composed of metallic material selected from the group consisting of aluminum, tin, copper, iron, nickel, manganese, titanium, carbon steel, stainless steel, galvanized steel, brass, bronze and mixtures thereof;

locating a nail sticking into a drywall surface;

holding onto the handle of the multipurpose drywall tool;

pounding down the located nail into the drywall surface with one of the rounded hammer members of the multipurpose drywall tool while holding onto the handle of the multipurpose drywall tool;

getting an aliquot of putty;

scooping out a portion of the putty from the aliquot of putty with the blade of the multipurpose drywall tool while holding onto the handle of the multipurpose drywall tool;

smearing the portion of putty over the pounded down nail in the drywall surface with the blade of the multipurpose drywall tool while holding onto the handle of the multipurpose drywall tool;

smoothing the smeared portion of putty onto the drywall surface with the blade of the multipurpose drywall tool while holding onto the handle of the multipurpose drywall tool;

finding a Phillips head screw screwed into the drywall surface;

inserting the screwdriver bit into the orifice in the distal end of the handle of the multipurpose drywall tool so that the Phillips-head bit points away from the distil end of the handle of the multipurpose drywall tool;

un-screwing the found Phillips head screw from the drywall surface with the screwdriver bit inserted into the orifice in the distal end of the handle of the multipurpose drywall tool to expose an aperture in the drywall surface;

ladling out a fraction of the putty from the aliquot of putty with the blade of the multipurpose drywall tool while holding onto the handle of the multipurpose drywall tool;

overlaying the fraction of the putty over the exposed aperture in the drywall surface;

identifying a slotted head screw screwed into the drywall surface;

withdrawing slidably the inserted screwdriver bit from the orifice in the distal end of the handle of the multipurpose drywall tool;

slipping in the screwdriver bit into the orifice in the distal end of the handle of the multipurpose drywall tool so that the slotted head bit points away from the distal end of the handle of the multipurpose drywall tool;

removing the identified slotted head screw from the drywall surface with the screwdriver bit slipped into the orifice in the distal end of the handle of the multipurpose drywall tool to expose a bore hole in the drywall surface;

taking out a parcel of the putty from the aliquot of putty with the blade of the multipurpose drywall tool while holding onto the handle of the multipurpose drywall tool; and covering up the exposed bore hole in the drywall surface with the parcel of putty with the blade of the multipurpose drywall tool while holding onto the handle of the multipurpose drywall tool.

* * * * *